US010830201B2

(12) United States Patent
Michels et al.

(10) Patent No.: US 10,830,201 B2
(45) Date of Patent: Nov. 10, 2020

(54) IGNITION SYSTEM HAVING A HIGH-FREQUENCY PLASMA-ENHANCED IGNITION SPARK OF A SPARK PLUG, INCLUDING AN ANTECHAMBER, AND A METHOD ASSOCIATED THEREWITH

(71) Applicants: VOLKSWAGEN AKTIENGESELLSCHAFT, Wolfsburg (DE); Rosenberger Hochfrequenztechnik GmbH & Co. KG, Fridolfing (DE)

(72) Inventors: Karsten Michels, Magdeburg (DE); Martin Fuchs, Freilassing (DE)

(73) Assignee: VOLKSWAGEN AKTIENGESELLSCHAFT, Wolfsburg (DE)

( * ) Notice: Subject to any disclaimer, the term of this patent is extended or adjusted under 35 U.S.C. 154(b) by 0 days.

(21) Appl. No.: 16/595,053

(22) Filed: Oct. 7, 2019

(65) Prior Publication Data

US 2020/0116119 A1 Apr. 16, 2020

(30) Foreign Application Priority Data

Oct. 10, 2018 (DE) ..... 10 2018 125 080

(51) Int. Cl.

| | |
|---|---|
| ***F02P 23/04*** | (2006.01) |
| ***F02P 9/00*** | (2006.01) |
| ***H01T 13/40*** | (2006.01) |
| ***H01T 13/50*** | (2006.01) |

(52) U.S. Cl.

CPC ..... *F02P 9/007* (2013.01); *H01T 13/40* (2013.01); *H01T 13/50* (2013.01)

(58) Field of Classification Search

CPC .. F02P 9/007; F02P 9/00; F02P 23/045; F02P 23/04; F02P 3/01; F02P 1/08; F02P 15/00; H01T 13/40; H01T 13/50; H01T 13/54; F02B 19/1023

USPC ..... 123/287, 169 EL, 143 B, 297, 298

See application file for complete search history.

(56) References Cited

U.S. PATENT DOCUMENTS

| | | | | |
|---|---|---|---|---|
| 9,867,270 | B2 * | 1/2018 | Ikeda | F02P 23/045 |
| 2012/0304958 | A1 | 12/2012 | Herden et al. | |
| 2015/0108914 | A1 | 4/2015 | Muramoto et al. | |
| 2016/0069320 | A1 | 3/2016 | Idicheria et al. | |
| 2017/0009730 | A1 | 1/2017 | Kim et al. | |

(Continued)

FOREIGN PATENT DOCUMENTS

| | | | |
|---|---|---|---|
| DE | 10 2004 058 925 | A1 | 6/2006 |
| DE | 10 2008 062 574 | A1 | 6/2010 |

(Continued)

*Primary Examiner* — Hai H Huynh

(74) *Attorney, Agent, or Firm* — Pearl Cohen Zedek Latzer Baratz LLP

(57) ABSTRACT

An ignition system and a method for a spark-ignition combustion engine having a high-frequency plasma-augmented ignition spark, the spark ignition of the fuel being realized by at least one spark plug associated with a combustion chamber of the combustion engine. The spark plug has a prechamber having at least one opening via which the prechamber communicates with the combustion chamber on the fuel side, so that the ignition spark in the prechamber, into which the high-frequency plasma can be injected, induces the plasma-augmented spark ignition of the fuel in the prechamber.

16 Claims, 4 Drawing Sheets

(56) References Cited

U.S. PATENT DOCUMENTS

| | | | |
|---|---|---|---|
| 2018/0058393 | A1 | 3/2018 | Honda |
| 2018/0135506 | A1 | 5/2018 | Grover, Jr. et al. |
| 2019/0113016 | A1 | 4/2019 | Wollitzer et al. |

FOREIGN PATENT DOCUMENTS

| | | | |
|---|---|---|---|
| DE | 10 2010 041 908 | A1 | 6/2011 |
| DE | 10 2010 000 349 | B3 | 11/2011 |
| DE | 10 2014 202 520 | B3 | 3/2015 |
| DE | 10 2015 114 718 | A1 | 3/2016 |
| DE | 10 2016 112 380 | A1 | 1/2017 |
| DE | 10 2017 214 641 | A1 | 3/2018 |
| WO | WO 2016/075361 | A1 | 5/2016 |
| WO | WO 2017/108389 | A1 | 6/2017 |
| WO | WO 2017/167437 | A1 | 10/2017 |

* cited by examiner

IGNITION SYSTEM HAVING A HIGH-FREQUENCY PLASMA-ENHANCED IGNITION SPARK OF A SPARK PLUG, INCLUDING AN ANTECHAMBER, AND A METHOD ASSOCIATED THEREWITH

CROSS-REFERENCE TO RELATED APPLICATIONS

This application claims priority from German Patent Application No. 10 2018 125 080.0, filed Oct. 10, 2018, which is hereby incorporated by reference.

FIELD OF THE INVENTION

The present invention relates to an ignition method and an ignition system, which is adapted for implementing the ignition method for igniting a fuel-air mixture or a fuel-air-exhaust gas mixture of a combustion engine having externally supplied ignition, in particular a spark-ignition engine.

BACKGROUND OF THE INVENTION

A combustion engine is known that has a prechamber configured between the combustion chamber and the intake manifold. The fuel is injected into the prechamber or, in some instances, also directly into the combustion chamber, so that the induced and compressed combustion air is used to prepare a fuel-air mixture. A spark plug, located in the prechamber, is referred to as a prechamber spark plug.

Between the electrode and ground, a high-voltage source, preferably configured as an ignition coil, provides a high-voltage pulse which causes a flashover between the electrode and the grounding contact. The ignition spark leads to an ignition of the fuel-air mixture or, in the case of exhaust gas recirculation, to an ignition of the fuel-air-exhaust gas mixture.

In the case of mixtures having a high level of excess air (lean mixture) and/or mixtures diluted by exhaust gas recirculation, flammability problems can occur and thereby result in incomplete combustion and/or misfirings of the fuel-air mixture.

Ignition systems are known that are coupled to a plasma generation. The World Patent Application WO 2017/167437 A1 discusses an ignition device for igniting a fuel-air mixture in a combustion chamber of a combustion engine using a spark plug that has three electrodes. It provides that the first electrode of the spark plug be connected to a high-voltage source for generating an electrical high-voltage pulse, so that the high-voltage pulse is applied to the first electrode. A second electrode is electrically connected to the ground potential. The third electrode of the spark plug is electrically connected to the output of a high-frequency voltage source, so that the high-frequency alternating voltage is applied to the third electrode to generate a plasma.

The World Patent Application WO 2017/108389 A1 discusses an ignition device for igniting a fuel-air mixture on the basis of the partial discharge principle. To this end, at least one of two electrodes of the ignition device is completely enclosed by a solid dielectric. If an electrical voltage pulse is applied between these electrodes, partial discharges are produced in response to the forming electrical field that can lead to generation of an ignition plasma and a flame core. Since the two electrodes are electrically insulated from each other by the dielectric surrounding at least one of the electrodes, a complete discharging cannot occur. Therefore, even at high ignition voltages, a reliable and stable inflammation of a fuel-air mixture can be realized without any significant erosion of the electrodes occurring.

The German Patent Application DE 10 2015 114 718 A1 provides that a combustion engine have a plasma ignition system having an ignition device that includes dielectric barrier discharging in the cylinder, and a fuel injection device for direct injection that includes a fuel jet in the cylinder. A controller functionally interconnects the combustion engine, the plasma ignition system and the fuel injection system. Prior to activation of the ignition device, the fuel injection device injects a first fuel pulse. The ignition device subsequently releases a plasma energy pulse. The fuel injection system is controlled to inject a second fuel pulse during the plasma energy pulse.

The German Patent Application DE 10 2017 214 641 A1 also discusses a combustion supporting device in a combustion engine equipped with a fuel injector. It provides that at least a portion of the fuel be injected into the intake manifold. Moreover, the combustion supporting device is provided with an electrode element, which is configured in the intake manifold and which has a high-frequency high voltage applied thereto.

The German Patent Application DE 10 2004 058 925 A1 describes an ignition system having a high-frequency plasma ignition for spark-ignition engines. The ignition system supplies a spatially extended plasma for igniting a fuel-air mixture in a combustion chamber. The high-frequency plasma ignition includes a resonant circuit that has an inductor, a high-frequency source for resonant excitation and a capacitor, the capacitor being formed by internal and external electrodes having a dielectric disposed therebetween, and these electrodes reaching into the combustion chamber with the outer ends thereof at a predefined mutual distance.

The German Examined Specification DE 10 2014 202 520 B3 describes a high-frequency discharge ignition device that can stably force a high-frequency current to flow into a spark discharge circuit and thus efficiently generate a large discharge plasma. The high-frequency discharge ignition device is configured with a spark plug, an ignition coil device, which generates a high voltage and feeds the generated high voltage to the spark plug in order to thereby form a spark discharge circuit in the gap of the spark plug, a voltage booster that amplifies the voltage of an alternating current, and a high-frequency current feed device that feeds an alternating current to the spark discharge circuit formed in the gap via the voltage booster.

SUMMARY OF THE INVENTION

It is, therefore, an object of the present invention to provide an improved ignition system for combustion engines having externally supplied ignition, in particular for spark ignition engines having prechamber ignition.

In particular, it is intended that the ignition system enhance the reliability of the ignition of the fuel-air mixture and ensure a complete combustion of the fuel-air mixture, even under unfavorable operating conditions.

It is particularly intended to counter the flammability problems that occur during operation of combustion engines having diluted, respectively lean fuel-air-exhaust gas mixtures, respectively fuel-air mixtures.

The operation of combustion engines having diluted fuel-air-exhaust gas mixtures should thereby be appreciably improved, respectively made possible in the first place, in particular in the case of combustion engines having exhaust gas recirculation.

An operation of the combustion engines at dilution rates of even (above) 25% exhaust gas recirculation (EGR), respectively at "lean rates" of (above) lambda >1.6 should be effectively made possible. It is intended that the present invention advantageously achieve a rise, i.e., an increase in the dilution of >/=5% higher EGR rates, respectively an increase in the lean rate of 0.1 to 0.3 oxygen units.

It is also intended, in particular that an effective operation of the combustion engines be possible in the lower part-load range. Furthermore, it is intended that the operation of a combustion engine equipped with the inventive ignition system increase the efficiency under such unfavorable operating conditions and reduce the emission of carbon monoxide and of unburned hydrocarbons from the fuel.

Moreover, it is intended that the ignition system be advantageously suited for an operation in accordance with the Miller combustion method and for supercharged gasoline engines having direct fuel injection.

The starting point of the present invention is an ignition system for a spark-ignition combustion engine, at least one spark plug associated with a combustion chamber of the combustion engine realizing the spark ignition of the fuel; a first electrode of the spark plug being electrically connected to a high-voltage output of a high-voltage source, and a second electrode being configured as a grounding contact; the first electrode of the spark plug being coupled to an ignition installation that has a high-frequency output to which a high-frequency voltage is applied; the high-voltage output of the high-voltage source of the spark plug and the high-frequency output being electrically interconnected; so that a voltage circuit formed by the high-voltage source of the spark plug between a first electrode and second electrode at the high-voltage output of the high-voltage source is amplified by the high-frequency voltage applied to the high-frequency output to generate the spark discharge of an ignition spark in response to the high-frequency voltage being injected via the high-frequency output into the voltage circuit of the high-voltage source, whereby, at/in the ignition spark, a high-frequency plasma may be injected, thereby enhancing the ignition reliability of the fuel in the combustion chamber by an additional energy input into the ignition spark and an increased ignition spark volume.

When the present patent application refers to power amplification, both a voltage amplification, as well as a current amplification may be provided. A reference to a high-frequency current may also mean a high-frequency voltage.

The present invention provides that the spark plug have a prechamber having at least one opening via which the prechamber communicates with the combustion chamber on the fuel side, so that the ignition spark in the prechamber, into which the high-frequency plasma may be injected, induces the plasma-augmented spark ignition of the fuel in the prechamber.

On the ignition installation side, the ignition system preferably includes a high-frequency generator and a power amplifier.

In a preferred embodiment, the ignition system includes a spark plug, which is a prechamber spark plug, including a cap having at least one opening, so that the prechamber of the prechamber spark plug is disposed between the cap and the first electrode.

In another preferred embodiment, the ignition system includes a spark plug, which is a top electrode spark plug that is likewise equipped with the prechamber having at least one opening.

It is also preferably provided that the ignition system in the combustion chamber have at least one sensor, which acquires at least one ignition parameter of the fuel.

The present invention also relates to an ignition method that preferably uses an ignition system having the aforementioned features and the features mentioned in the description.

The ignition installation according to the present invention is adapted for implementing the inventive method explained in the following. For this purpose, the ignition installation includes, in particular a control device in which are stored a computer-readable programming algorithm for implementing the method and possibly required ignition maps.

The starting point of the method is a spark-ignition combustion engine, the spark ignition of the fuel being realized by at least one spark plug associated with a combustion chamber of the combustion engine, a first electrode of the spark plug being electrically connected to a high-voltage output of a high-voltage source, and a second electrode being configured as a grounding contact; the first electrode of the spark plug being coupled to an ignition installation that has a high-frequency output to which a high-frequency voltage is applied; the high-voltage output of a high-voltage source of the spark plug and the high-frequency output being electrically interconnected, so that a voltage circuit formed by the high-voltage source of the spark plug between a first electrode and second electrode at the high-voltage output of the high-voltage source is amplified by the high-frequency voltage applied to the high-frequency output to generate the spark discharge of an ignition spark in response to the high-frequency voltage being injected via the high-frequency output into the voltage circuit of the high-voltage source, whereby, at/in the ignition spark, a high-frequency plasma is injected, thereby enhancing the ignition reliability of the fuel in the combustion chamber by an additional energy input into the ignition spark and an increased ignition spark volume.

The present invention provides that the spark plug have a prechamber having at least one opening via which the prechamber communicates with the combustion chamber on the fuel side, allowing the ignition spark to be formed in the prechamber, into which the high-frequency plasma is injected, thereby inducing a plasma-augmented spark ignition of the fuel in the prechamber.

In response to injection of the high-frequency voltage into the voltage circuit of the high-voltage source at the output of the ignition installation, a high-voltage pulse is advantageously formed that has a high-frequency voltage superimposed thereon. The ignition method is preferably characterized by the high-frequency plasma being generated at a predefinable initiation instant prior to, concurrently with, or subsequently to the ignition of the ignition spark, and by it being injected into the ignition spark.

It is preferably provided, in particular that the high-frequency plasma be initiated, at the latest, 0.5 ms prior to ignition of the ignition spark or, at the latest, 0.5 ms subsequently to ignition of the ignition spark, therefore, generated and injected.

Starting at the initiation instant, the high-frequency plasma is preferably sustained for a predefinable burning duration of up to 2.5 ms.

Moreover, it is preferably provided that the burning duration of the high-frequency plasma be variable and be varied as a function of sensor-acquired ignition parameters of the fuel in the combustion chamber.

Thus, the present invention provides that the burning duration of the high-frequency plasma be variable as a function of the sensor-acquired ignition parameters and, in response to poor ignition parameters, be lengthened, respectively in response to good ignition parameters, be shortened; in response to good ignition parameters, a burning duration of the high-frequency plasma of <1 ms being set, or the generation of the high-frequency plasma being set.

The ignition method preferably provides that the high-frequency voltage at the high-frequency output of the power amplifier have a frequency of 1 to 100 MHz and a voltage within a voltage amplitude of between 0.1 kV and 30 kV, especially of between 0.4 kV and 1 kV.

In an especially preferred embodiment, the high-frequency current generated by the high-frequency generator via the power amplifier at the high-frequency output is superimposed on a voltage ramp at the high-voltage output upon injection into the voltage circuit of the high-voltage source. This has a constructive effect on the ignition voltage demand of the high-voltage source, advantageously reducing the ignition voltage demand of the high-voltage source at the high-voltage output of the high-voltage source.

It is also provided that sensors acquire the ignition parameters of a fuel-air mixture or of a fuel-air-exhaust gas mixture in the combustion chamber, and that the spark plug be ignited and the high-frequency plasma generated as a function of at least one of the acquired ignition parameters; to generate the high-frequency plasma, at least one actual operating variable, in particular the frequency of the high-frequency signal and/or the voltage amplitude and/or an initiation instant being adapted to the at least one predefinable nominal-actual operating variable by an additional energy input into the ignition spark and/or an ignition spark volume augmented by the injected high-frequency plasma, as a function of the magnitude of the at least one acquired ignition parameter.

A charge dilution of the fuel, which is present at the ignition point of the ignition spark of the spark plug due to enleanment or due to external or internal residual gas recirculation of the fuel in the combustion chamber, is provided, in particular as a magnitude for an ignition parameter, as a function of which, the actual operating variable is adapted to the predefined nominal-actual operating variable.

The high voltage generated at the high-voltage output of the high-voltage source produces a flashover between the first electrode and the second electrode configured as a grounding contact, and thus an ignition spark which ignites the fuel-air mixture, respectively the fuel-air-exhaust gas mixture, causing combustion. Here, the ignition spark forms the spark channel.

The present invention advantageously enables the spark channel to receive the generated high-frequency plasma due to the inventive "injection" of the high-frequency power, the high-frequency plasma feeding additional energy into the ignition spark within the prechamber to ignite a fuel-air mixture, respectively a fuel-air-exhaust gas mixture, in addition, the result advantageously being an augmented ignition spark volume and a longer burning duration of the plasma.

The present invention thereby provides that the spark channel still exists when the high-frequency plasma is generated at a predefinable initiation instant, making it possible for the spark channel to receive the high-frequency plasma. In other words, first, the spark breaks through, which is more powerful and intense subsequently to the initiation instant in response to the high-frequency plasma than it is without the same, whereby the high-frequency plasma continues to feed and sustain the spark channel.

It is ultimately thereby achieved that the entire fuel-air mixture or the fuel-air-exhaust gas mixture is (more) reliably and (more) fully ignited even under otherwise unfavorable inflammation conditions.

The generated high-frequency plasma and the high-frequency plasma injected into the spark channel advantageously result in a dissociation of the molecular oxygen in atomic oxygen. The atomic oxygen, which is thus available for the combustion and the thereby formed radicals, advantageously result in the entire fuel-air mixture or the fuel-air-exhaust gas mixture being more reactive and thus igniting more rapidly and reliably. Thus, the fuel-air mixture, respectively the fuel-air-exhaust gas mixture are advantageously more readily flammable, thereby appreciably enhancing the ignitability of the fuel-air mixture, respectively of the fuel-air-exhaust gas mixture. The conductive channel formed by the spark channel is produced, sustained and stabilized for a longer period of time due to the energy additionally supplied by the high-frequency plasma. Because of the burning duration of the high-frequency plasma, the spark channel is preferably sustained at a high energy for a length of time of up to 2.5 ms. Extending the time the spark channel is sustained to up to 2.5 ms makes it advantageously possible for more energy to be supplied to the fuel-air mixture, respectively to the fuel-air-exhaust gas mixture as a function of the acquired ignition parameters than in known methods heretofore.

Moreover, the high temperature of the spark channel is advantageously maintained for a longer time due to the additional supply of energy.

Thus, a (virtually) complete combustion may ultimately be advantageously realized using the ignition system according to the present invention, even for combustion engines operated with charge dilution, in the sense of leaner fuel-air mixtures, so that, even when working with lean mixtures (enleanment), which are characterized by excess air, and when working with fuel-air-exhaust gas mixtures diluted by exhaust gas recirculation (charge dilution due to internal or external exhaust gas recirculation EGR), the otherwise low (er) flammability mixtures are reliably ignited.

At the same time, the high-frequency plasma advantageously augments the volume of the ignition spark, whereby the inflammation of low-flammability mixtures is likewise improved by the augmentation of the contact area of the spark channel for the fuel-air mixture, respectively for the fuel-air-exhaust gas mixture.

The low-flammability mixtures occur, in particular in an engine operation in the lower part-load range.

The present invention enhances the reliability and integrity of the ignition of low-flammability fuel-air mixtures, respectively fuel-air-exhaust gas mixtures.

The ignition system designed in accordance with the present invention makes possible a reliable and efficient fuel-air mixture ignition, respectively fuel-air-exhaust-gas mixture ignition in all operating ranges, especially in the part-load range as well, for a direct-injection combustion engine equipped therewith.

Specifically, the present invention makes it possible to reliably operate gasoline engines having significantly higher charge dilution, especially part-load operation. At the same time, this mode of operation has the effect of reducing the nitrogen-oxide emissions.

In the same way, the improved combustion will reduce the emission of unburned or only incompletely burned hydrocarbons of the fuel. Besides reducing pollutant emissions, the specific fuel consumption of the engine is decreased at the same time.

In comparison to an ignition by high-frequency plasma assistance in a main combustion chamber (without prechamber), the use of a prechamber spark plug or a top electrode spark plug having a prechamber, the ignition reliability is advantageously significantly enhanced by the high-frequency plasma generation in the ignition spark within the prechamber when working with a diluted charge.

This makes possible a higher dilution rate, and thus a further reduction in fuel consumption. It is possible, in particular to lessen the known ignition problem of the prechamber spark plugs (without high-frequency plasma assistance).

In particular, the present invention provides for the use of the inventive ignition system and the implementation of the inventive method in a charge diluted engine, i.e. an engine operated with exhaust gas recirculation, in particular a charged, direct injection gasoline engine and/or a gasoline engine operated in accordance with the Miller method.

BRIEF DESCRIPTION OF THE DRAWINGS

The present invention is clarified in the following with reference to the accompanying drawings, in which.

DETAILED DESCRIPTION OF THE INVENTION

First Specific Embodiment

Figure 1A:
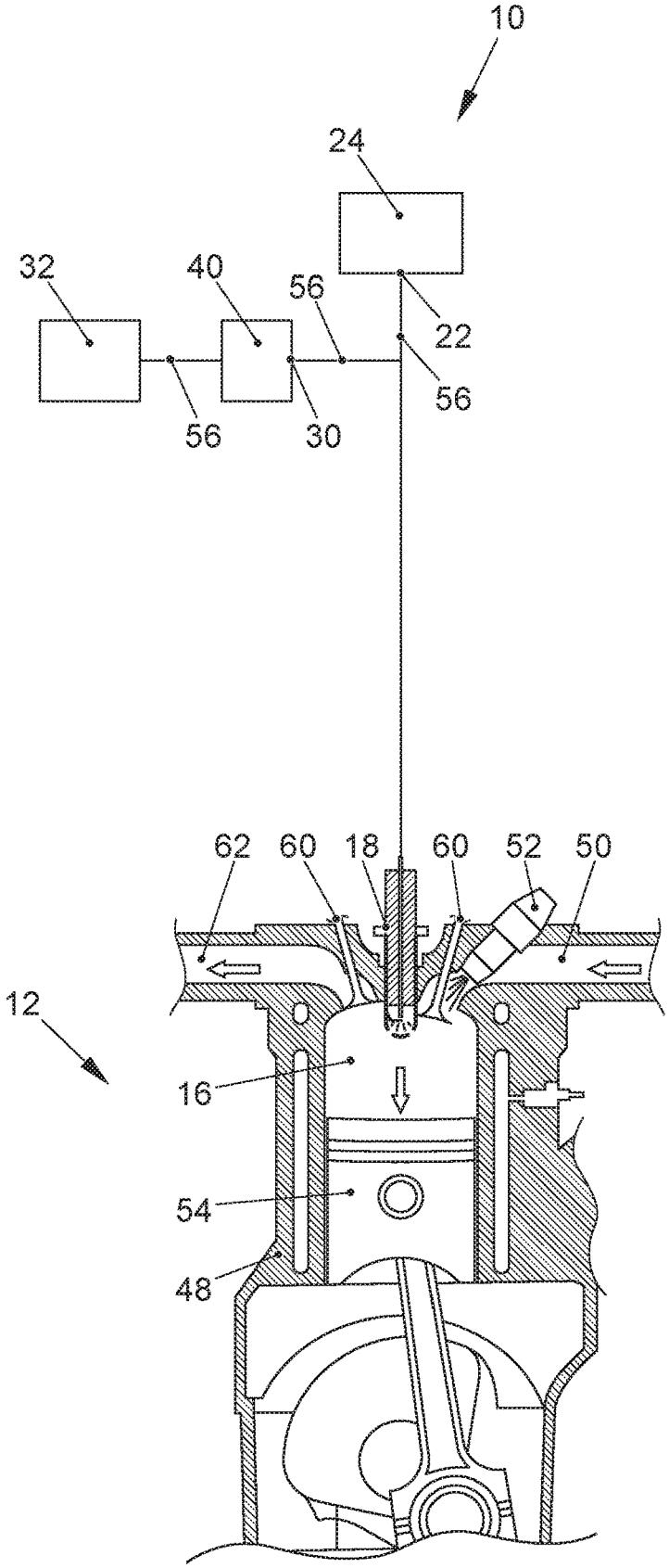
FIG. 1A shows, in a first specific embodiment, a cylinder of a combustion engine in which a spark plug having a prechamber, in particular a prechamber spark plug, is located, which is connected to an ignition installation and which, together with an ignition coil functioning as a high-voltage source, a high-frequency generator and a power amplifier, makes up the ignition system according to the present invention.
Figure 1B:
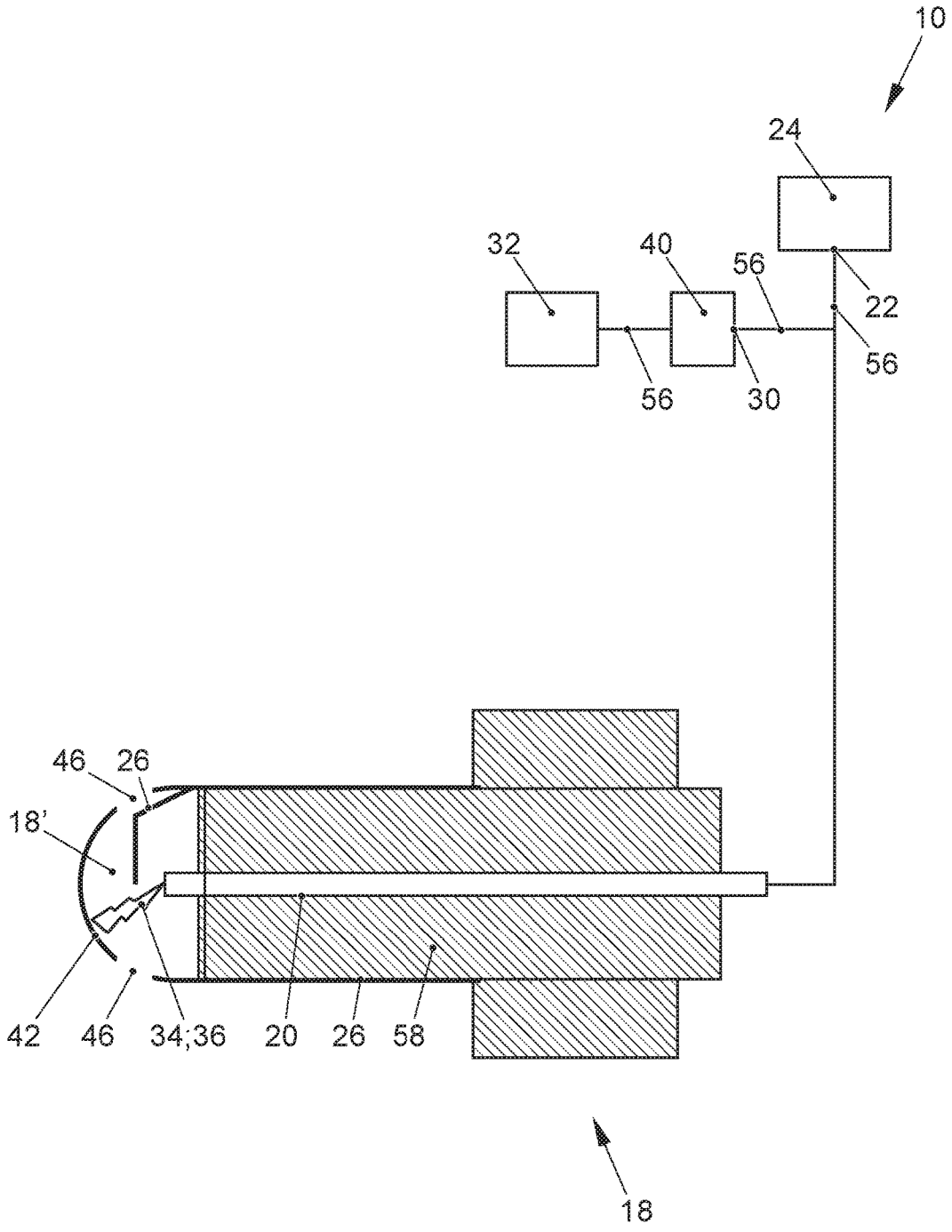
FIG. 1B shows, in the first specific embodiment, the prechamber spark plug (without a cylinder of the combustion engine), including the ignition installation, which, together with the ignition coil, the high-frequency generator and the power amplifier makes up the ignition system according to the present invention.

In an overall view, FIGS. 1A and 1B show a prechamber spark plug 18 of an ignition system 10, which is configured in a combustion chamber 16 of combustion engine 12, and which, besides prechamber spark plug 18, includes as the ignition installation for spark ignition, in particular an ignition coil 24, a high-frequency generator 32 and a power amplifier 40.

Prechamber spark plug 18 includes a first electrode 20, in particular in the form of a center electrode, and a prechamber 18' and a second electrode 26 as a ground electrode.

Spark plug 18, in particular the prechamber spark plug, has at least one opening 46 in a cap 42, so that a prechamber 18' of prechamber spark plug 18 is disposed between cap 42 and first electrode 20. Via the at least one opening 46, prechamber 18', which forms a prechamber ignition space, communicates with main combustion chamber 16 (compare FIG. 1A).

Injector 52 performs the injection of a fuel into main combustion chamber 16 (compare FIG. 1A). In response to the injection of the fuel into the air induced by intake manifold 50 or in response to an air-exhaust-gas mixture enriched by an exhaust gas recirculation, a fuel-air mixture or a fuel-air-exhaust-gas mixture is produced in combustion chamber 16, which, in a generally known manner, is compressed by the upward movement of piston 54. During the compression stroke of piston 54, the fuel-air mixture or a fuel-air-exhaust gas mixture enters into prechamber 18' of prechamber spark plug 18.

The ignition of the fuel-air mixture or of the fuel-air-exhaust gas mixture is initiated by ignition spark 34 in prechamber 18', in particular in the prechamber ignition space of prechamber 18'.

To this end, the appropriate high ignition voltage is fed from high-voltage output 22 of ignition coil 24 via an electrical line realized as an ignition cable 56 to center electrode 20 of prechamber spark plug 18.

Ignition spark 34 is initiated in the intended manner to ignite the fuel-air mixture or the fuel-air-exhaust gas mixture.

Prior to or concurrently with the formation of ignition spark 34 or subsequently to the already formed ignition spark 34, a high-frequency voltage produced by high-frequency generator 32 and fed, and thus amplified, by power amplifier 40 is conducted from high-frequency output 30 to center electrode 20 of prechamber spark plug 18; therefore, injected into high-voltage output 22 of ignition coil 24 at a predefinable initiation instant (prior to, concurrently with, or subsequently to the formation of ignition spark 34).

The conductive channel realized by ignition spark 34 is consequently acted upon by the generated and injected high-frequency plasma 36, and the thus formed ignition spark 34 is charged with higher energy, as well as preferably sustained for a longer period of time, and becomes more voluminous than conventional ignition sparks in response to injected high-frequency plasma 36.

High-frequency plasma 36 advantageously produces more radicals from the molecular compounds of the particular mixture in addition to a conventional ignition spark, thereby leading to a more stable and more rapid inflammation.

In combination, the higher-energy charging of ignition spark 34, the sustaining of ignition spark 34 for a longer period of time, and the larger volume of ignition spark 34 advantageously result in increased ignition energy, leading to more reliable ignition of less flammable fuel-air mixtures, respectively fuel-air-exhaust gas mixtures. Accordingly, even leaner fuel-air mixtures, respectively diluted fuel-air-exhaust gas mixtures having partially charged/compressed combustion air recirculation are more reliably and more completely ignited.

The more reliable initiation (ignition) results in a more complete combustion of the fuel-air mixture or of the fuel-air-exhaust gas mixture, whereby vehicle emissions are reduced. In addition, the specific fuel consumption is reduced, and damage to combustion engine 12 and prechamber spark plug 18 is prevented.

A cylinder of an engine block 48 of a combustion engine 12, shown in FIG. 1A, is designed in a conventional manner to include control valves 60, in particular intake and exhaust valves, in the area of an intake manifold 50 and in the area of an exhaust manifold 62.

Second Specific Embodiment

Figure 2A:
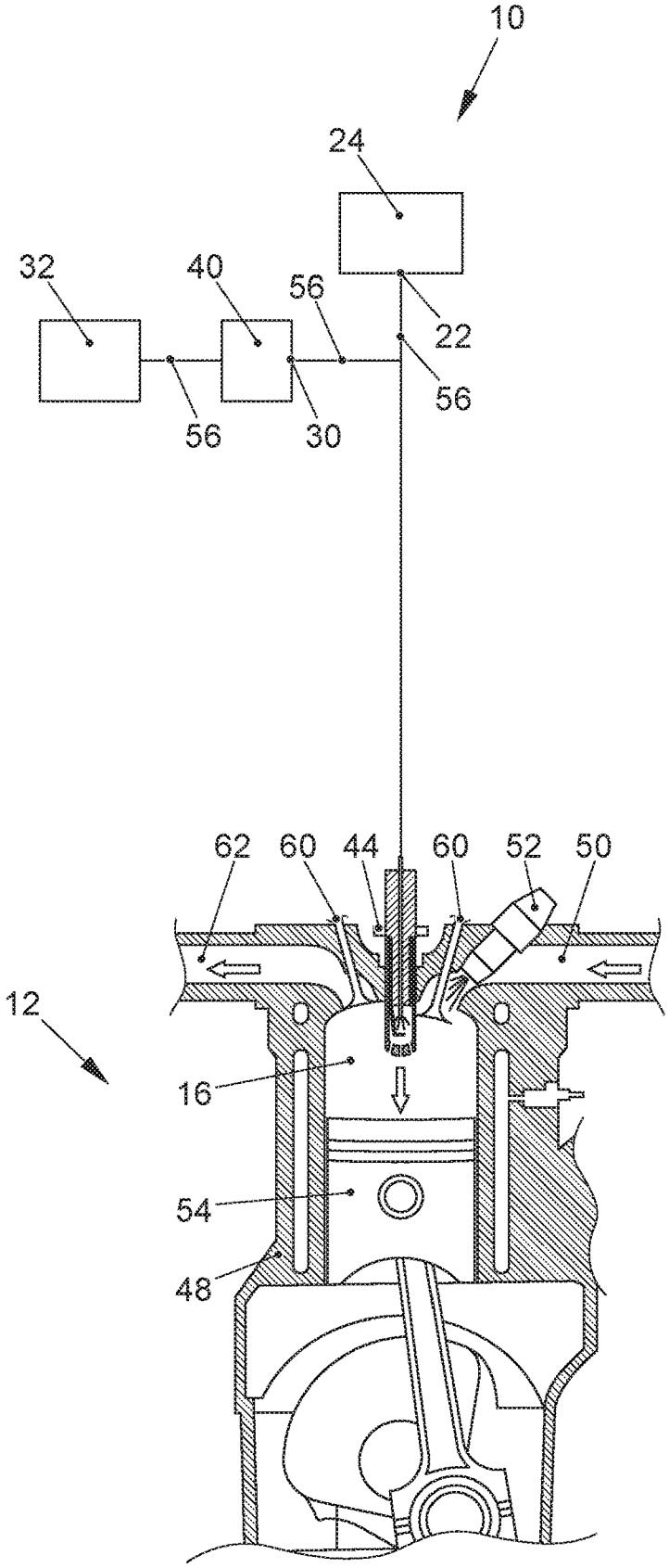
FIG. 2A shows, in a second specific embodiment, a cylinder of a combustion engine in which a spark plug having a prechamber, in particular a top electrode spark plug, is configured and connected to an ignition installation, and which, together with an ignition coil, a high-frequency generator, and a power amplifier, makes up the ignition system according to the present invention.
Figure 2B:
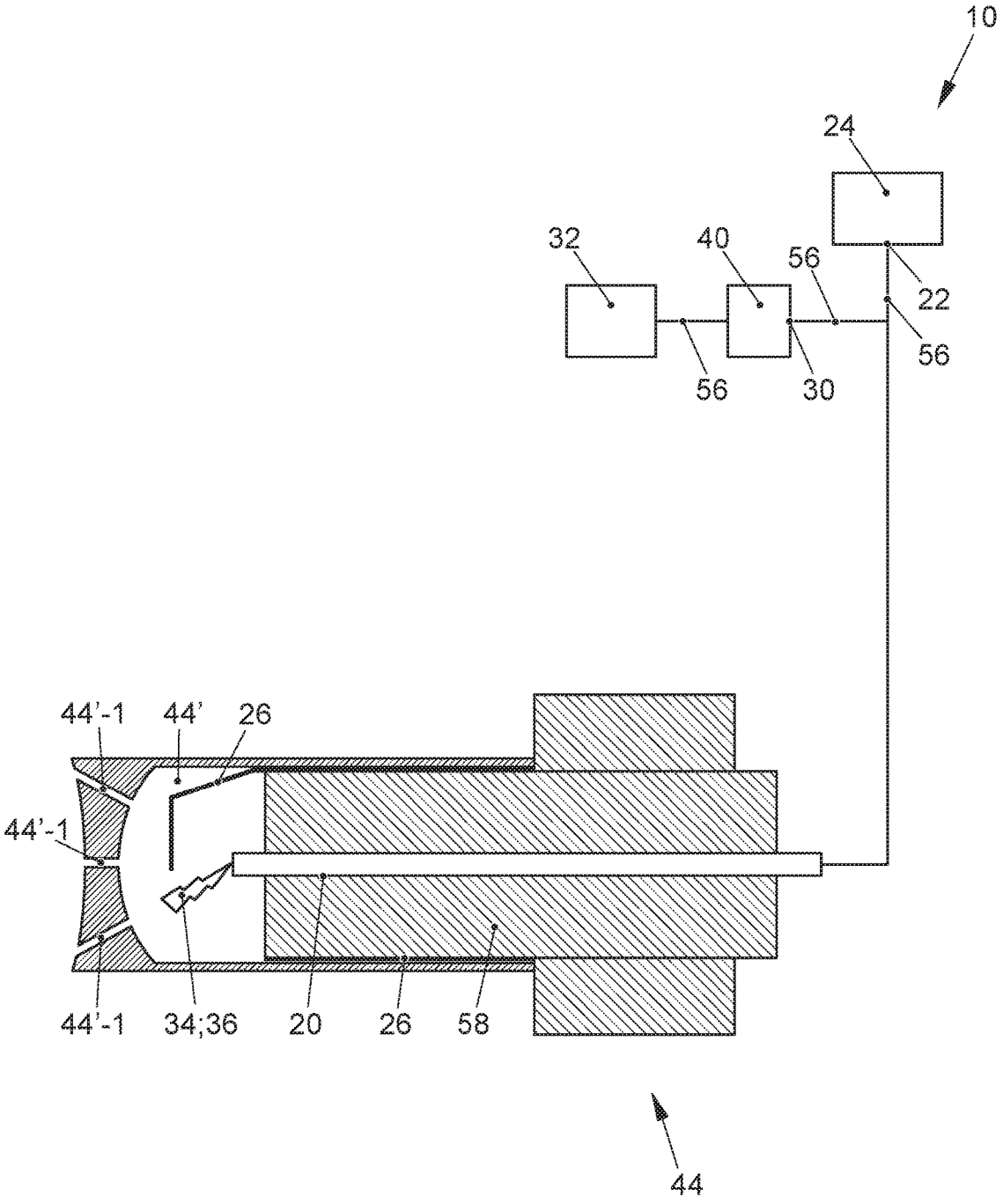
FIG. 2B shows, in the second specific embodiment, the prechamber spark plug (without cylinders of the combustion engine), including the ignition installation, which, together with the ignition coil, the high-frequency generator and the power amplifier, makes up the ignition system according to the present invention.

In an overall view, FIGS. 2A and 2B show a top electrode spark plug 44 of an ignition system 10, which is configured in a combustion chamber 16 of combustion engine 12 and which, analogously to the first specific embodiment, besides top electrode spark plug 44, includes an ignition coil 24, a high-frequency generator 32 and a power amplifier 40 as the ignition installation for spark ignition of top electrode spark plug 44.

Top electrode spark plug 44 includes a first electrode 20, in particular in the form of a center electrode, and a prechamber 44' and a second electrode 26 as a ground electrode.

Top electrode spark plug 44 is equipped with prechamber 44' having at least one opening 44'-1. Prechamber 44', which forms a prechamber ignition space, communicates via the least one opening 44'-1 with main combustion chamber 16 (compare FIG. 2A).

Injector 52 performs the injection of a fuel into main combustion chamber 16 (compare FIG. 1A). In response to the injection of the fuel into the air induced by intake manifold 50 or in response to air-exhaust-gas mixture enriched by an exhaust gas recirculation (EGR), a fuel-air mixture or a fuel-air-exhaust-gas mixture is produced in combustion chamber 16 and, in a generally known manner, is compressed by the upward movement of piston 54. During the compression stroke of piston 54, the fuel-air mixture or a fuel-air-exhaust gas mixture enters into prechamber 44' of top electrode spark plug 44.

Ignition spark 34 in prechamber 44', in particular in the prechamber ignition space of prechamber 44', advantageously initiates the ignition of the fuel-air mixture or of the fuel-air-exhaust gas mixture and provides the described effects.

The description of the inventive method that is valid for the first specific embodiment and for the design of the ignition installation and for ignition system 10 as a whole also applies to the second specific embodiment, which is shown in FIGS. 2A and 2B analogously to the first specific embodiment.

Differences in the use of a prechamber spark plug 18 having a prechamber 18' and a top electrode spark plug 44 having a prechamber 44' are that top electrode spark plug 44 having a prechamber 44' has two parts, i.e., top electrode spark plug 44 and prechamber 44' are two individual components, whereby, structurally, the space requirements are somewhat greater, but the components may be individually replaced. This difference is especially advantageous for the replacement interval for the spark plugs since, generally, a spark plug does not function for the entire service life of the vehicle.

REFERENCE NUMERAL LIST

10 ignition system
12 internal combustion engine, combustion engine
16 combustion chamber
18 prechamber spark plug
18' prechamber of the prechamber spark plug
20 first electrode, center electrode
22 high-voltage output
24 high-voltage source, ignition coil
26 second electrode; ground electrode
30 high-frequency output
32 high-frequency generator
34 ignition spark
36 high-frequency plasma
40 power amplifier
42 cap
44 top electrode spark plug
44' prechamber of the top electrode spark plug
44'-1 openings in the prechamber of the top electrode spark plug
46 openings in the cap of the prechamber spark plug
48 engine block
50 intake manifold
52 injector
54 piston
56 ignition cable
58 insulator
60 control valve
62 exhaust manifold

The invention claimed is:

1. An ignition system for a spark-ignition combustion engine, comprising:

at least one spark plug configured to provide the spark ignition of fuel, the at least one spark plug being associated with a combustion chamber of the combustion engine;

a first electrode of the spark plug that is electrically connected to a high-voltage output of a high-voltage source;

a second electrode of the spark plug that is configured as a grounding contact;

wherein the first electrode of the spark plug is coupled to an ignition installation that has a high-frequency output to which a high-frequency voltage is applied;

wherein the high-voltage output of the high-voltage source of the spark plug and the high-frequency output are electrically interconnected, so that, in a voltage circuit that includes the high-voltage source of the spark plug, the high-voltage output of the high-voltage source is amplified by the high-frequency voltage applied to the high-frequency output to generate a spark discharge between the first electrode and the second electrode of an ignition spark in response to the high-frequency voltage being injected via the high-frequency output into the voltage circuit of the high-voltage source, whereby, at/in the ignition spark, a high-frequency plasma can be injected, thereby enhancing the ignition reliability of the fuel in the combustion chamber by an additional energy input into the ignition spark and an increased ignition spark volume, wherein the spark plug has a prechamber having at least one opening via which the prechamber communicates with the combustion chamber on the fuel side, so that the ignition spark in the prechamber, into which the high-frequency plasma can be injected, induces the plasma-assisted spark ignition of the fuel in the prechamber.

2. The ignition system as recited in claim 1, wherein the ignition installation includes a high-frequency generator and a power amplifier.

3. The ignition system as recited in claim 1, wherein at least one sensor, which acquires at least one ignition parameter of the fuel, is located in the combustion chamber.

4. An ignition method for a spark-ignition combustion engine, comprising:

providing the spark ignition of the fuel by at least one spark plug associated with a combustion chamber of the combustion engine, wherein a first electrode of the spark plug is electrically connected to a high-voltage output of a high-voltage source and a second electrode is configured as a grounding contact;

applying a high-frequency voltage to a high-frequency output, wherein the first electrode of the spark plug is coupled to an ignition installation that has the high-frequency output, and wherein the high-voltage output of a high-voltage source of the spark plug and the high-frequency output are electrically interconnected, so that, in a voltage circuit, which includes the high-voltage source of the spark plug, the high-voltage output of the high-voltage source is amplified by the high-frequency voltage applied to the high-frequency output to generate a spark discharge between a first electrode and second electrode of an ignition spark in response to the high-frequency voltage being injected via the high-frequency output into the voltage circuit of the high-voltage source, injecting a high-frequency plasma at/in the ignition spark, which enhances the ignition reliability of the fuel in the combustion chamber by an additional energy input into the ignition spark and an augmented ignition spark volume, wherein the spark plug has a prechamber having at least one opening via which the prechamber communicates with the combustion chamber on the fuel side, allowing the ignition spark to be formed in the prechamber, into which the high-frequency plasma is injected, thereby inducing a plasma-augmented spark ignition of the fuel in the prechamber.

5. The ignition method as recited in claim 4, further comprising forming a high-voltage pulse in response to injection of the high-frequency voltage into the voltage circuit of the high-voltage source at the output of the ignition installation, wherein the high-voltage pulse has a high-frequency voltage superimposed thereon.

6. The ignition method as recited in claim 5, wherein the high-frequency plasma is generated at a predefinable initiation instant prior to, concurrently with, or subsequently to ignition of the ignition spark, and is injected thereinto.

7. The ignition method as recited in claim 6, further comprising sustaining the high-frequency plasma, starting at the initiation instant, for a predefinable burning duration of up to 2.5 ms.

8. The ignition method as recited in claim 7, wherein the burning duration of the high-frequency plasma is variable, and wherein the method further comprises varying the burning duration as a function of sensor-acquired ignition parameters of the fuel in the combustion chamber.

9. The ignition method as recited in claim 7, further comprising:

lengthening the burning duration as a function of the sensor-acquired ignition parameters in response to poor ignition parameters, and shortening the burning duration in response to good ignition parameters;

wherein, in response to good ignition parameters, a burning duration of the high-frequency plasma of <1 ms is set, or the generation of the high-frequency plasma is set.

10. The ignition method as recited in claim 8, further comprising acquiring a magnitude of the charge dilution of the fuel as an ignition parameter, which is present due to enleanment or due to external or internal residual gas recirculation of the fuel in the combustion chamber at the time of ignition of the ignition spark of the spark plug.

11. The ignition method as recited in claim 5, further comprising adapting the ignition installation for initiating, generating and injecting the high-frequency plasma:

at the latest 0.5 ms prior to ignition of the ignition spark, or at the latest, 0.5 ms subsequently to ignition of the ignition spark.

12. The ignition method as recited in claim 5, wherein the injected high-frequency voltage at the high-frequency output of the power amplifier has a frequency of 1 to 20 MHz, and a voltage within a voltage amplitude of between 0.1 kV and 30 kV.

13. The ignition method as recited in claim 12, wherein the frequency of the power amplifier is 8 to 12 Mhz.

14. The ignition method as recited in claim 12, wherein the voltage amplitude of the power amplifier is between 0.4 kV and 1 kV.

15. The ignition method as recited in claim 5, further comprising:

superimposing a voltage ramp at the high-voltage output of the high-voltage source on the high-frequency voltage of the high-voltage source generated by the high-frequency generator via the power amplifier at the high-frequency output upon injection into the voltage circuit to create a constructive effect on the ignition voltage demand of the high-voltage source, and reducing the ignition voltage demand of the high-voltage source at the high-voltage output of the high-voltage source.

16. The ignition method as recited in at least one of the claim 4, further comprising:

acquiring, via at least one sensor, at least one ignition parameter of a fuel-air mixture or of a fuel-air-exhaust gas mixture in the combustion chamber, wherein the spark plug is ignited and the high-frequency plasma is generated as a function of at least one of the acquired ignition parameters; and generating the high-frequency plasma by adapting at least one actual operating variable to at least one predefinable nominal-actual operating variable by an additional energy input into the ignition spark and/or an ignition spark volume augmented by the injected high-frequency plasma, as a function of the magnitude of the at least one acquired ignition parameter, wherein the at least one actual operating variable is the frequency of the high-frequency voltage and/or the voltage amplitude and/or the initiation instant, being adapted.

* * * * *